US006405884B1

(12) United States Patent
Dion

(10) Patent No.: US 6,405,884 B1
(45) Date of Patent: Jun. 18, 2002

(54) PALLET RACK REINFORCEMENT UNIT

(75) Inventor: Dany Dion, La Plaine (CA)

(73) Assignee: Damotech Inc., Boisbriand (CA)

( * ) Notice: Subject to any disclaimer, the term of this patent is extended or adjusted under 35 U.S.C. 154(b) by 0 days.

(21) Appl. No.: 09/644,882

(22) Filed: Aug. 23, 2000

Related U.S. Application Data

(63) Continuation-in-part of application No. 09/414,222, filed on Oct. 7, 1999, now Pat. No. 6,298,537, which is a continuation-in-part of application No. 09/149,987, filed on Sep. 9, 1998, now abandoned.

(30) Foreign Application Priority Data

Aug. 25, 1999 (CA) ..... 2280645

(51) Int. Cl.[7] ..... A47F 5/00

(52) U.S. Cl. ..... 211/189; 211/183; 211/182; 211/191

(58) Field of Search ..... 211/191, 189, 211/192, 183, 207, 182; 248/243, 244

(56) References Cited

U.S. PATENT DOCUMENTS 2,925,181 A * 2/1960 Saul, Jr. et al. ..... 211/147
3,545,626 A * 12/1970 Seiz ..... 211/176
3,626,487 A * 12/1971 Seiz ..... 211/176
3,637,087 A * 1/1972 Denny ..... 211/176
3,854,686 A * 12/1974 Konstant ..... 248/243
4,088,229 A * 5/1978 Jacoby et al. ..... 211/191
4,239,122 A * 12/1980 Klein ..... 211/182
5,181,815 A * 1/1993 Haberkorn ..... 410/140
5,749,481 A * 5/1998 Miller ..... 211/191
6,332,549 B1 * 12/2001 MacDonald ..... 211/183

* cited by examiner

*Primary Examiner*—Daniel P. Stodola
*Assistant Examiner*—Khoa Tran
(74) *Attorney, Agent, or Firm*—Eric Fincham

(57) ABSTRACT

A reinforcement unit for pallet racks wherein first and second tubular post, each having a floor bearing plate secured to a lower end thereof and a horizontal support plate secured to the upper end thereof, along with generally C-shaped connecting members for receiving an original portion of the pallet rack, may be used to reinforce the bottom of existing pallet racks and avoid having to replace the entire rack when it is damaged.

5 Claims, 4 Drawing Sheets

PALLET RACK REINFORCEMENT UNIT

The present application is a continuation-in-part of application Ser. No. 09/414,222 filed Oct. 7, 1999, now U.S. Pat. No. 6,298,537 which is a ontinuation-in-part of application Ser. No. 09/149,987 filed Sep. 9, 1998, now abandoned.

FIELD OF THE INVENTION

The present invention relates to pallet racking arrangements and more particularly, relates to a method system for reinforcing pallet racks.

BACKGROUND OF THE INVENTION

Pallet racks originally received wide usage in warehouses wherein typically they would extend in a plurality of rows for substantially the height of the building with space being provided between the rows for forklift trucks to move. The forklift trucks would then remove stock from the shelves for the shipping of quantities thereon or for further processing.

More recently, the opening of large warehouse stores to the public have utilized such pallet racks for direct access by the consumer. In this arrangement, the warehouse and retail functions are combined.

Inherently, there are dangers in such a system and safeguards against collapse must be provided. To date, most of the safety concerns have centered around the various design criteria to ensure that the pallet racks are capable of accepting the loads to which they are subjected. Normally, the pallet racks are of a knock down design wherein the shelves or beams are hooked onto a post. The posts are generally perforated to receive the hook elements and various designs of the post have been proposed in the art. One may, for example, refer to U.S. Pat. No. 4,064,996 illustrating such a post structure.

While the use of pallet racks achieves substantial economies for the user, they are very susceptible to damage. Inherently, the loaded pallets must be lifted onto the racks by fork lift trucks. Due to the sometimes limited spaces, accidents are quite frequent wherein the fork lift truck will accidentally collide with one of the support posts. With the very high loads which the pallet racks carry, this is a dangerous situation and any post even slightly damaged must be replaced.

In order to replace the damaged post, the loaded pallets must be removed from the structure and the rack disassembled. After repair, the pallets must then be reloaded on the structure.

The above process is both an expensive and time consuming one. Frequently, once the post has been damaged, the forces acting on the structure will then cause damage to some of the bracing and beams. For safety reasons, it frequently becomes necessary to replace a substantial portion of the structure.

Although it has been proposed in the art to provide post protectors—see U.S. Pat. No. 4,113,110, such post protectors do not assist in preventing damage to the post at a height above the protector.

It is also known to provide a repair system for pallet racks such as shown in Canadian Patent 2,232,178. The present invention provides an improvement to such a repair system and may be installed at the time of installation of the pallet racks.

SUMMARY OF THE INVENTION

According to the present invention, there is provided a reinforcement unit which may be utilized with any known type of pallet rack system and a method for improving pallet rack systems.

In greater detail, the reinforcement unit of the present invention is designed to work with all standard pallet racks. In this respect, it will be understood that different pallet racks will have different dimensions and the reinforcement unit will be configured accordingly.

According to one aspect of the present invention, there is provided a reinforcement unit for pallet racks comprising a first tubular post having an upper end and a lower end, a first floor bearing plate secured to the first tubular post at the lower end thereof, a first horizontal support plate secured to the first tubular post at the upper end thereof, a first connecting member secured to the upper end of the first tubular post, the first connecting member having a portion thereof secured to the first tubular post and a further portion extending upwardly above the first support plate, a second tubular post having an upper end and a lower end, a second floor bearing plate secured to the second tubular post at the lower end thereof, a second horizontal support plate secured to the second tubular post at the upper end thereof, a second connecting member secured to the upper end of the second tubular post, the second connecting member having a portion thereof secured to the second tubular post and a further portion extending upwardly above the second support plate and a horizontal frame member extending between the first tubular post and the second tubular post.

The reinforcement unit of the present invention is designed to be sufficiently sturdy to withstand any damage from lift trucks and the like. Accordingly, it is constructed of sufficiently robust material and in preferred embodiments, the post and braces are made of steel between ¼ and 3/16 inch thick. The same material will be used for the connecting members.

BRIEF DESCRIPTION OF THE DRAWINGS

Having thus generally described the invention, reference will be made to the accompanying drawings illustrating an embodiment thereof, in which.

DESCRIPTION OF THE PREFERRED EMBODIMENTS

Figure 1:
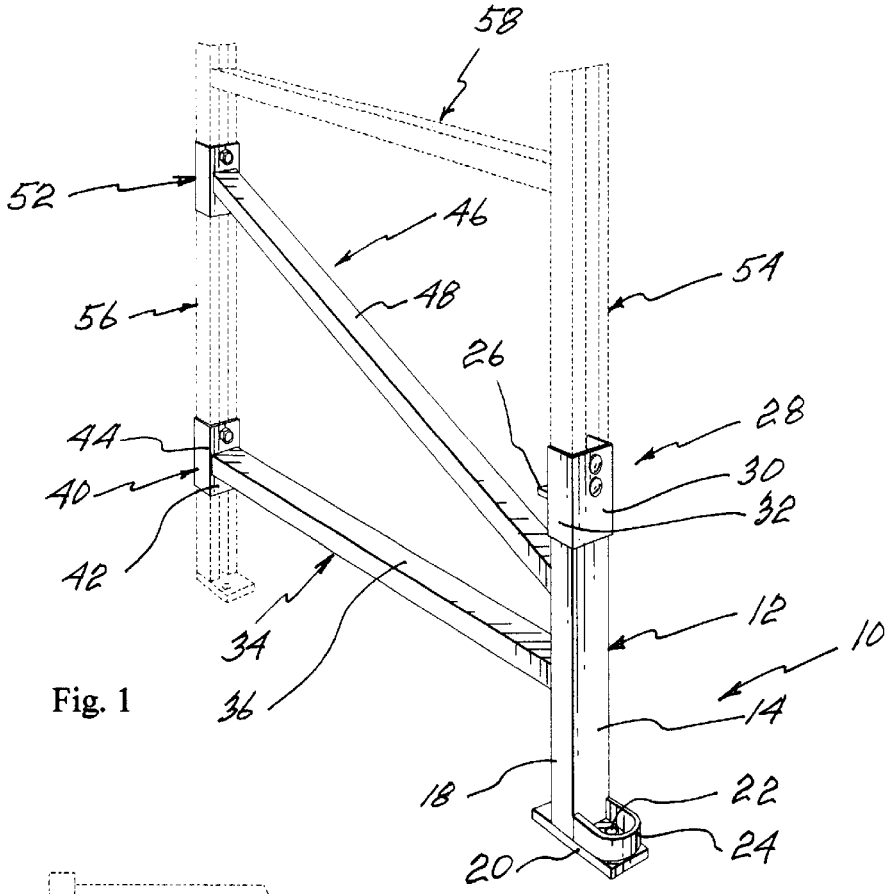
FIG. 1 is a perspective view of a repair system.

Referring to the drawings in greater detail, and by reference characters thereto, there is illustrated in FIG. 1 a repair assembly which is generally designated by reference numeral 10.

Repair assembly 10 includes a tubular post 12, having a front wall 14, an opposed side wall 16, and a pair of side walls, only one side wall 18 being shown.

Located at the bottom of tubular post 12 is a floor bearing plate 20. Floor bearing plate 20 extends beyond both front wall 14 and back wall 16; the portion extending past front wall 14 has an aperture 22 therein to receive a fastening member such as a bolt which will be secured to the floor. A C-shaped bolt guard 24 extends substantially about the periphery of the portion extending beyond front wall 14 to protect the bolt from damage. Similarly, an aperture is provided in the portion of floor bearing plate 20 extending past back wall 16.

At the upper end of tubular post 12 there is a horizontal plate 26 welded thereto. Also surrounding horizontal plate 26 and the upper portion of tubular post 12 is a C-shaped connector 28 having a front wall 30, a portion of which lies in juxtaposition with front wall 14 of tubular post 12, there remaining portion extending upwardly to receive the existing post of the pallet rack as will be discussed in greater detail hereinbelow. Similarly, side wall 32 lies in juxtaposition to side wall 18 of tubular post 12.

A horizontal brace 34 extends outwardly from back wall 16. Horizontal brace 34 has an upper wall 36 and a bottom wall 38 which are substantially the same as back wall 16 to thereby provide a very strong connection. Similarly, a diagonal brace 46 extends diagonally outwardly and upwardly from back wall 16. In this respect, it will be noted that diagonal brace 46 is located a distance above horizontal brace 34 and extends at an angle of approximately 26 degrees. Diagonal brace 46 includes a top wall 48 and a bottom wall 50 which are slightly narrower than back wall 16 of tubular post 12.

A C-shaped connector generally designated by reference numeral 40 is located at the distal end of horizontal beam 34 and includes a front wall 42 and a pair of side walls, only one side wall 44 being shown. Similarly, a C-shaped connector 52 is provided at the distal end of diagonal brace 46.

Figure 2:
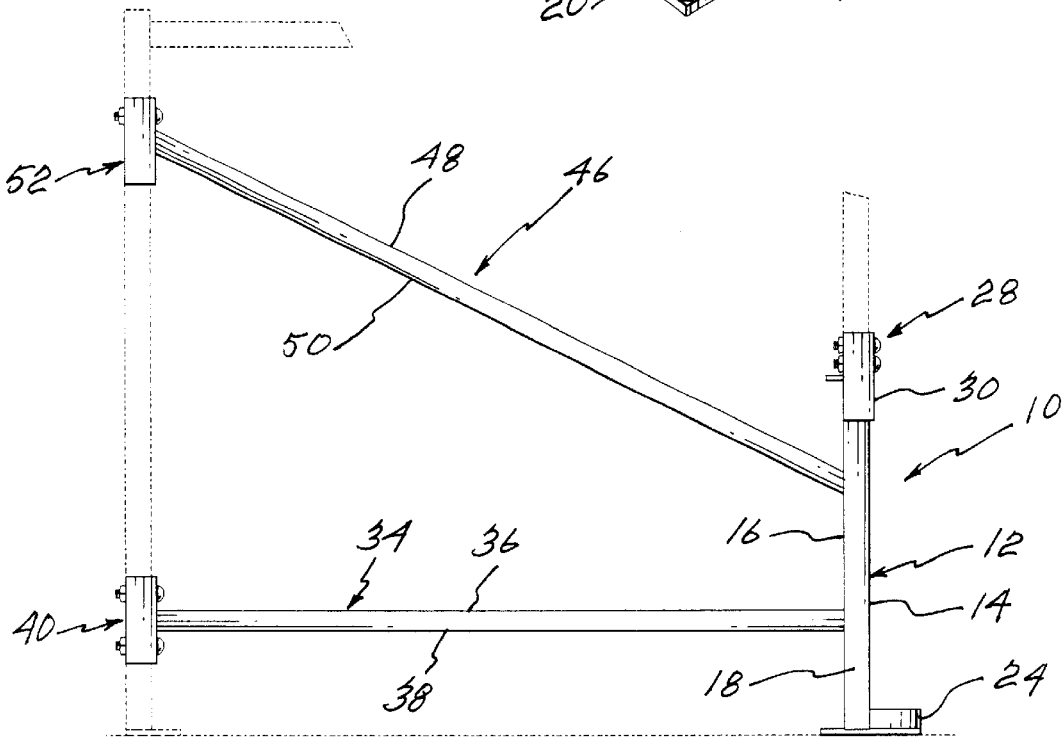
FIG. 2 is a side elevational view thereof.

Repair assembly 10, in FIGS. 1 and 2, is shown after having replaced a portion of a damaged post 54 as used in a conventional pallet rack arrangement. In the pallet rack arrangement there is also provided a rear post 56 and an upper horizontal brace 58.

Figure 4:
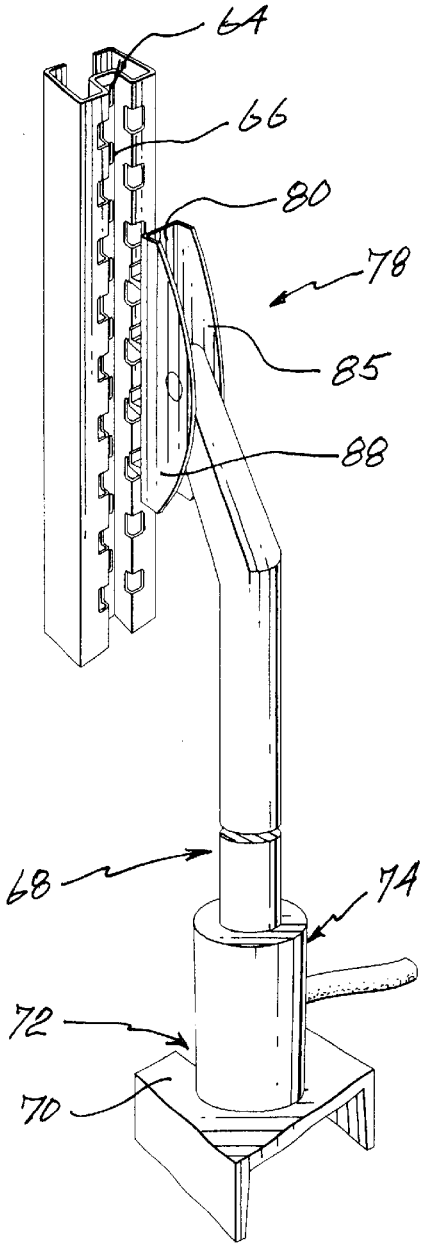
FIG. 4 is a perspective view of the equipment utilized during replacement of the damaged post of the pallet rack.
Figure 5:
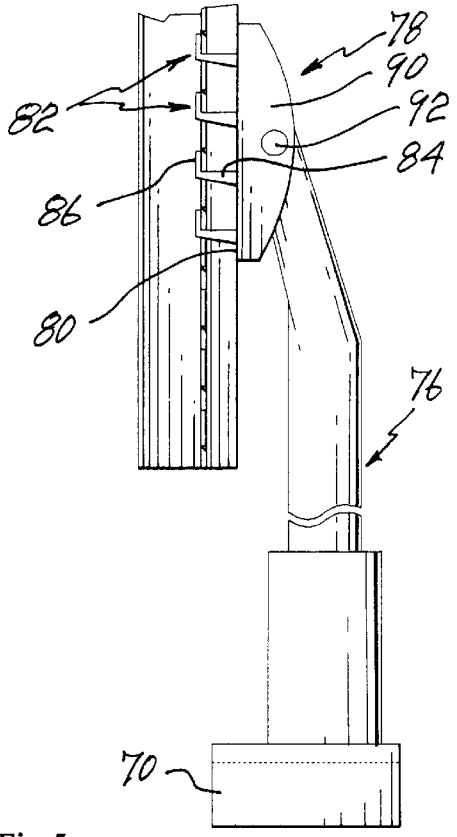
FIG. 5 is a side view illustrating engagement of the equipment with the damaged post.
Figure 6:
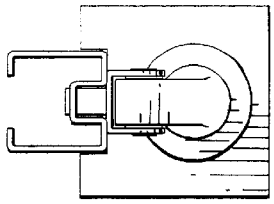
FIG. 6 is a top plan view of the equipment of FIG. 5.
Figure 7:
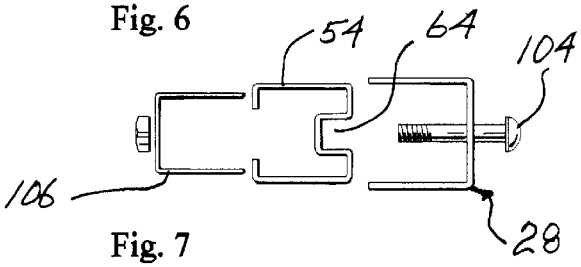
FIG. 7 is a exploded view of the means of securing the repair assembly to the post.
Figure 8:
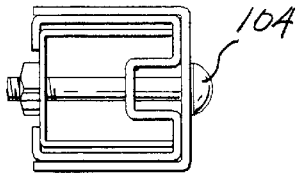
FIG. 8 is a cross sectional view of the assembled connector of FIG. 7.

Each of posts 54 and 56, and as may be best seen in FIG. 4, is of a formed steel having an inwardly extending channel 64 with apertures 66 located therein. This is similar to the arrangement shown, for example, in U.S. Pat. No. 4,064,996 to Shillum.

In practicing the method of the present invention, reference will now be made to the steps involved therein.

There is provided a lifting mechanism generally designated by reference numeral 68 and which includes a base 70 having a recess 72 formed therein to permit placement of the lifting mechanism proximate to front post 54. Mounted on base 70 is a hydraulic jack 74 having an arm 76 extending upwardly therefrom. At the distal end of arm 76 there is provided a post engaging attachment generally designated by reference numeral 78. Post engaging attachment 78 will be specific to the type of post being repaired and thus a number of different attachments may be employed.

Post engaging attachment 78 includes a front wall 80 from which a plurality of members 82 extend. Each member 82 has a horizontal portion 84 which is substantially perpendicular to front wall 80 and an upwardly extending portion 86. A pair of side walls 88 extend rearwardly from front wall 80, each side wall 88 having an aperture 90 formed therein to receive a pin 92 for attachment to arm 76.

Referring to FIGS. 3, 3*a*, 3*b* and 3*c*, there is illustrated front post 54 which has been hit by a lift truck and has a lower damaged portion 96 and an upper undamaged portion 98 (horizontal and diagonal braces not shown). Initially, lifting mechanism 68 is placed into position whereby members 82 extending from front wall 80 will engage with upper undamaged portion 98 through apertures 66. Hydraulic jack 74 is then operated to lift post 54 to the extent necessary to remove any weight bearing on lower damaged portion 96. Lower damaged portion 96 is then removed as indicated by cut line 100.

Figures 3, 3A, 3B, 3C:
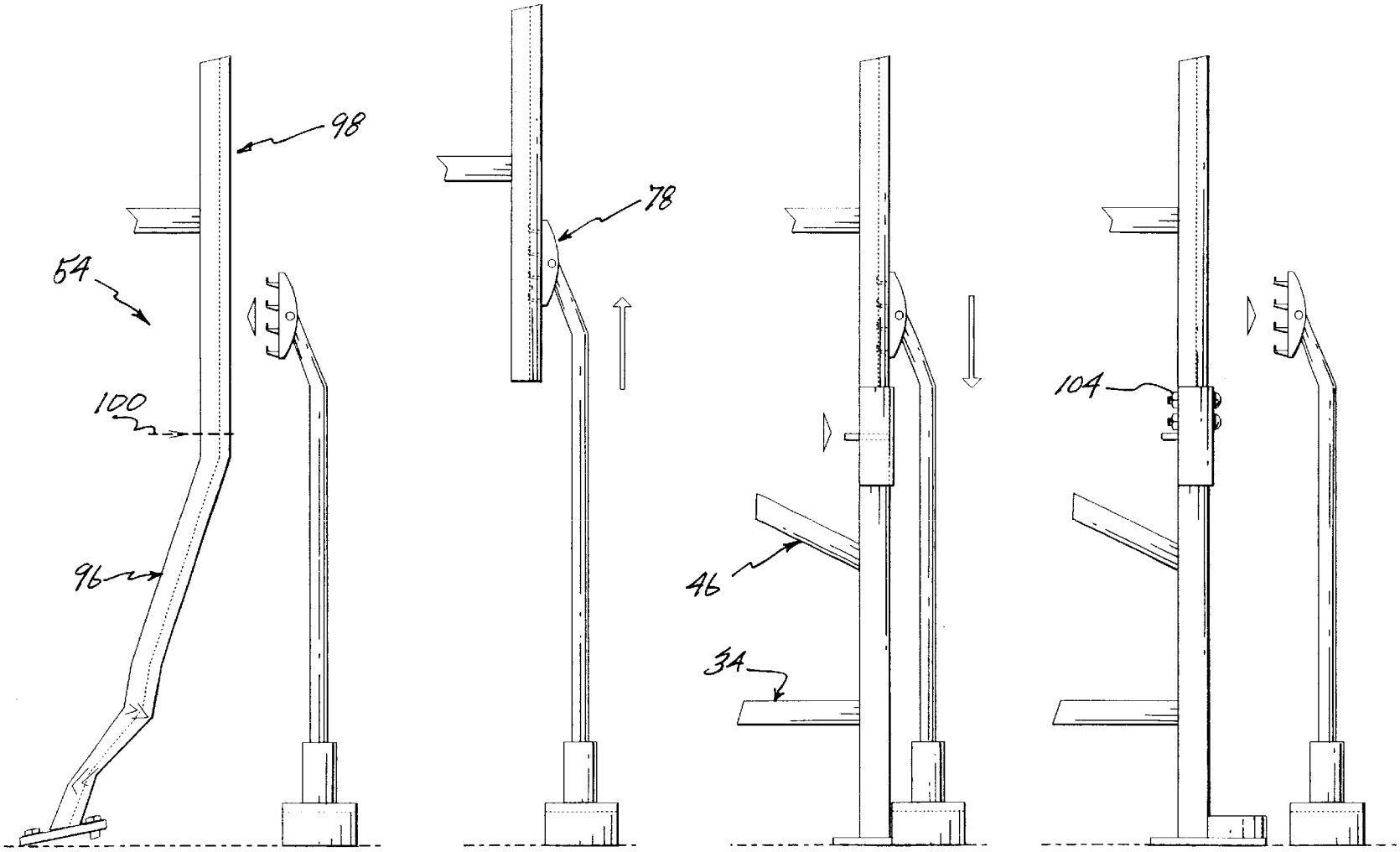
FIGS. 3, 3*a*, 3*b* and 3*c* illustrate the replacement of a damaged post of a pallet rack.

Subsequently, repair assembly 10 is moved into position as shown in FIG. 3*b* and hydraulic jack 74 is then lowered to permit the bottom end of upper undamaged portion 98 to rest on horizontal plate 86. A rear C-shaped reinforcing plate 106 is placed inwardly of channel 64 and bolts 104 are then secured through C-shaped connector 28. A similar procedure is followed with respect to connectors 40 and 52 located at the distal ends of horizontal brace 34 and diagonal brace 46 respectively.

Figure 9:
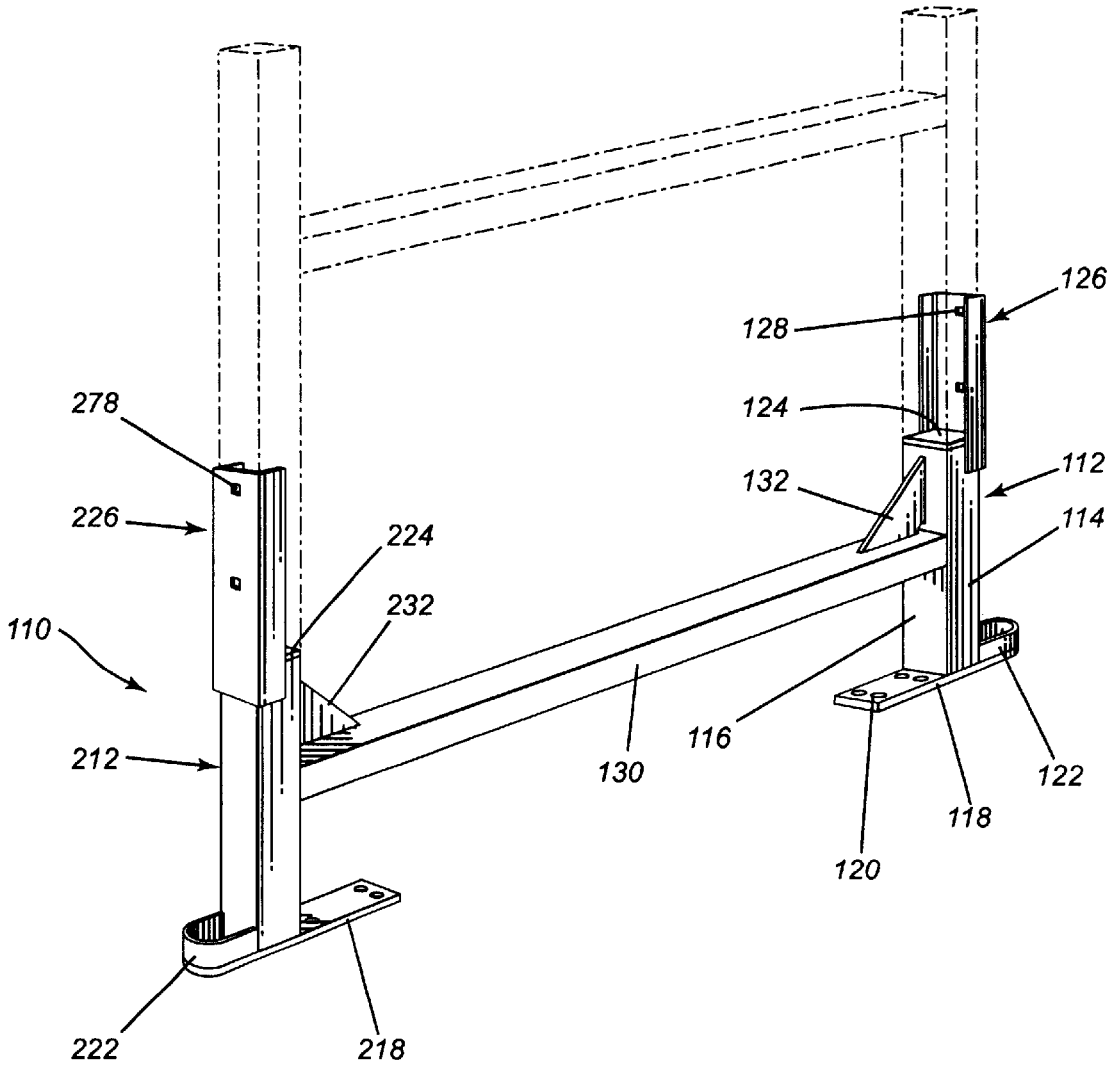
FIG. 9 is a perspective view of a reinforcement unit according to the present invention.

Referring to FIG. 9, there is illustrated a reinforcement unit which is generally designated by reference numeral 110.

Reinforcement unit 110 is designed to support the front and back legs of a pallet rack and any number of such units may be used when the pallet racks are being installed.

Reinforcement unit 110 includes a tubular post 112 preferably of a non-apertured configuration and made of material sufficiently strong to withstand impacts from fork lift trucks and the like. Tubular post 112 is rectangular in configuration and includes a side wall 114 and an inner wall 116. At the bottom of tubular post 112 there is provided a floor bearing plate 118 having apertures 120 therein for securing floor bearing plate 118 to the floor which is normally of a concrete material. As in the description relating to the repair system, there is provided a C-shaped bolt guard 122.

At the upper end of tubular post 112 there is provided a horizontal bearing plate 124. A C-shaped connector 126 extends upwardly therefrom and includes apertures 128 for connection to a conventional pallet rack. A horizontal beam 130 is secured to inner wall 116 and there is provided a triangular brace 132.

At the other end of horizontal beam 130, there is provided a second tubular post 212 which is identical to tubular post 112 and thus will not be described in detail. However, similar reference numerals in the 200s have been employed for identical components.

In use, reinforcement units 110 are placed in position such that horizontal bearing plates 124 and 224 will receive the legs of a conventional pallet rack. C-shaped connectors 126 and 226 are used for securing the legs of the conventional pallet rack.

It will be understood that the above described embodiment is for purposes of illustration only and that changes and modifications may be made thereto without departing from the spirit and scope of the invention.

I claim:

1. A reinforcement unit for pallet racks comprising:

a first tubular post having an upper end and a lower end;

a first floor bearing plate secured to said first tubular post at said lower end thereof;

a first horizontal support plate secured to said first tubular post at said upper end thereof, said first horizontal support plate extending across said tubular post;

a first connecting member secured to said upper end of said first tubular post, said first connecting member having a portion thereof secured to said first tubular post and a further portion extending upwardly above said first support plate;

a second tubular post having an upper end and a lower end;

a second floor bearing plate secured to said second tubular post at said lower end thereof;

a second horizontal support plate secured to said second tubular post at said upper end thereof, said second horizontal support plate extending across said second tubular post;

a second connecting member secured to said upper end of said second tubular post, said second connecting member having a portion thereof secured to said second tubular post and a further portion extending upwardly above said second support plate; and a horizontal frame member extending between said first tubular post and said second tubular post.

2. The reinforcement unit of claim 1 wherein each of said first floor bearing plate and said second floor bearing plate have apertures formed therein for receiving a bolt.

3. The reinforcement unit of claim 2 wherein each of said first floor bearing plate and said second floor bearing plate have a generally C shaped bolt guard around said apertures.

4. The reinforcement unit of claim 3 further including a first triangular brace extending between said horizontal frame member and said first tubular post and a second triangular brace extending between said horizontal frame member and said second tubular post.

5. A repair assembly for pallet racks comprising:

a tubular post having an upper end and a lower end;

a floor bearing plate secured to said tubular post at said lower end thereof;

a horizontal support plate secured to said tubular post at said upper end thereof, said support plate extending across said tubular post;

a connecting member secured to said upper end of said tubular post, said connecting member having a portion thereof secured to said tubular post and a further portion extending upwardly above said support plate;

a horizontal brace extending perpendicularly outwardly from a wall of said tubular post;

a horizontal brace clamping member located at a distal end of said horizontal brace;

a diagonal brace extending upwardly and outwardly from said wall of said tubular post; and a diagonal brace clamping member located at a distal end of said diagonal brace.

* * * * *